US009829863B1

(12) United States Patent
Bird

(10) Patent No.: US 9,829,863 B1
(45) Date of Patent: Nov. 28, 2017

(54) DIGITAL-TO-DIGITAL CORRECTION UNIT FOR ANALOG CLOCK DISPLAY

(71) Applicant: Charles Richard Bird, Saline, MI (US)

(72) Inventor: Charles Richard Bird, Saline, MI (US)

( * ) Notice: Subject to any disclaimer, the term of this patent is extended or adjusted under 35 U.S.C. 154(b) by 0 days.

(21) Appl. No.: 15/153,804

(22) Filed: May 13, 2016

(51) Int. Cl.
*G04C 13/02* (2006.01)
*G04C 3/14* (2006.01)

(52) U.S. Cl.
CPC ..... *G04C 13/02* (2013.01); *G04C 13/027* (2013.01); *G04C 3/14* (2013.01)

(58) Field of Classification Search
CPC ..... G04C 3/14; G04C 13/02; G04C 13/027
See application file for complete search history.

(56) References Cited

U.S. PATENT DOCUMENTS 4,077,198 A 3/1978 Mayenschein
4,182,108 A 1/1980 Chihara
4,192,134 A 3/1980 Yoshida
4,196,583 A 4/1980 Komaki
4,198,810 A 4/1980 Fahrenschon
4,242,747 A 12/1980 Fahrenschon
4,280,211 A 7/1981 Mayenschein
4,320,484 A 3/1982 Burdet
4,342,030 A 7/1982 Shanks
4,396,294 A 8/1983 Yoshida
4,400,092 A 8/1983 Piquet et al.
4,408,896 A 10/1983 Ikegami
4,436,435 A 3/1984 Ushikoshi
4,501,502 A 2/1985 Van Orsdel
4,666,311 A 5/1987 Maire
4,956,828 A 9/1990 Yamada
5,181,190 A 1/1993 Kanzaki
5,274,545 A 12/1993 Allen
5,299,178 A 3/1994 Belik
5,303,211 A 4/1994 Yanaka
5,379,281 A 1/1995 Koch
5,422,863 A 6/1995 Minowa et al.
5,619,478 A 4/1997 Mutoh
5,642,335 A 6/1997 Taylor
6,038,523 A * 3/2000 Akahane ..... G01D 5/2492 368/250
6,084,828 A 7/2000 Bland
6,147,933 A 11/2000 Bland
6,307,815 B1 * 10/2001 Polosky ..... G04C 1/065 368/220
6,343,050 B1 1/2002 Kwok
6,454,458 B1 9/2002 Born et al.
(Continued)

*Primary Examiner* — Amy Cohen Johnson
*Assistant Examiner* — Jason Collins
(74) *Attorney, Agent, or Firm* — Heed Law Group PLLC; Thomas P Heed

(57) ABSTRACT

A clock device for timekeeping with an analog display and a time correction unit. The time correction unit uses encoder disks and rotary encoders to convert the angular position of the minute hand and the hour hand to a slave time code. The slave time code is compared to a master time code. A feedback circuit drives the minute hand and hour hand drive-motor(s) until the slave time code equals the master time code. The master time code can be generated from a digital clockworks, or it can be transmitted to the present invention from another clock. The invention can be extended to include a second hand and a time correction unit for a second hand.

20 Claims, 10 Drawing Sheets

(56) References Cited

U.S. PATENT DOCUMENTS

| | | | | |
|---|---|---|---|---|
| 6,807,129 | B1 | 10/2004 | Chan | |
| 7,173,883 | B2 | 2/2007 | Seyr | |
| 7,394,727 | B2 | 7/2008 | Ushikoshi | |
| 7,854,544 | B2 | 12/2010 | Cheng | |
| 7,875,844 | B2 * | 1/2011 | Sheu | G01D 5/3473 250/231.16 |
| 8,432,772 | B2 | 4/2013 | Meis | |
| 8,467,274 | B2 * | 6/2013 | Aoki | G04C 3/146 368/187 |
| 8,929,179 | B2 | 1/2015 | Matsuo | |
| 8,934,321 | B2 | 1/2015 | Fung | |

* cited by examiner

DIGITAL-TO-DIGITAL CORRECTION UNIT FOR ANALOG CLOCK DISPLAY

FIELD OF INVENTION

This invention relates to the class of horology. Specifically, this invention relates to chronology and chronographs.

BACKGROUND OF INVENTION

The clock is one of the oldest human inventions, with time-keeping mechanisms, such as sun-dials and water clocks, pre-dating history. Major advancements in the precision of time-keeping occurred in the 1300s with the invention of the mechanical escapement, the 1500s with the invention of the mechanical spring-driven clock, and the 1600s with the pendulum clock.

Clocks existed significantly before clock faces or dials. The first mechanical clocks were striking clocks, designed to ring on the hour. The clock dial with an hour hand came into use in the late 1300s. The minute hand only came into widespread use around 1690, after the invention of the pendulum and anchor escapement. The direction of motion of the clock hands about the face, so-called clockwise, imitate the movement of the sundial in the northern hemisphere. The analog clock face, with an hour hand, minute hand, and twelve hours laid in a circle, has remained largely unchanged for three hundred years or more. There is a substantial preference for the simplicity and aesthetics of the analog clock face.

A mechanical clock relies on the inner mechanical spring-loaded clockwork, or a pendulum, to stabilize the period of oscillation, which is how a mechanical clock maintains accurate time. But friction robs these mechanical oscillators of a tiny bit of energy on every stroke. As the aggregate energy loss increases, the oscillations slow, leading to deteriorating accuracy for the clock. A mainspring or pendulum is designed to counterbalance this effect, continually adding stored energy to the system to keep things on track. But a mainspring or pendulum is not an infinite source of additive energy; in a mainspring clockwork, the clock must be wound periodically; in a pendulum clock, the anchor escapement has to be reset periodically. As an alternative, an electronic source can add energy to the mechanical clock.

There are also fully electronic movements, such as piezoelectric crystal oscillators, which use a piezoelectric quartz crystal to generate an electrical signal with a specific frequency, rather than rely on a series of gears and pendulums. The period of vibration for a piezoelectric crystal depends on the size and shape of the crystal. While crystal oscillators are susceptible to temperature, humidity, pressure, and vibration fluctuations, their effects are much more controllable and correctable than their mechanical counterparts.

As a result of the foregoing, modern digital clocks are much more accurate timekeepers than analog clocks attached to mechanical clockworks. Digital clock displays, typically using light-emitting diodes ("LEDs"), liquid crystal displays ("LCDs"), or thin-film transistors ("TFTs", a variant of LCDs) have become commonplace.

In summary, the current state of time-keeping finds that digital clocks are more accurate because the analog clocks with mechanical clockworks have to account for a number of sources of inaccuracy and energy loss: friction, inertia, thermal variation, wear, and gravity, inter alia. A mechanical clock needs to be wound, or have some other source of additive energy, because the spring force eventually is exhausted overcoming energy loss. Digital clocks use crystal oscillators, or other electronic circuitry, that do not have similar inaccuracies and energy losses. As a result of the higher accuracy, digital clock displays with electronic/piezoelectric movements are supplanting the ubiquity of analog clock displays with mechanical movements. Additionally, electronic/piezoelectric movements have been mated with analog clock displays.

Although people tend to prefer the aesthetics of an analog clock display, they prefer the accuracy and ease-of-use of electronic clockworks. The main failure mode of electronic clockworks is that the power can fail, causing someone to have to reset all the electronic clocks so affected. Additionally, when mated with an analog display, an electronic clockwork can be somewhat inaccurate, due to the tolerance inherent in the angular positioning of the hour and minute hand. What is needed is a way of automatically resetting an electronic clock with an analog display, so that the analog display is always accurate.

PRIOR ART REVIEW

There is clearly a market demand for a clock with an analog display, that is accurate, that will reset after a power outage, and that does not need to be wound or otherwise attended to.

There is prior art related to master/slave arrangements of clocks, which attempt to meet this market demand, but all of them fall short. For example, U.S. Utility Pat. No. 8,934,321, by named inventor Fung, entitled, "Analog quartz timepiece and method for providing time-correction of the same," teaches a quartz timepiece with an analog display that uses optics to detect the position of the hands, and then adjusts them to the correct. U.S. Utility Pat. No. 8,929,179, by named inventor Matsuo, entitled, "Analog electronic timepiece having rotating display bodies and a detection unit detecting when a rotating display body is in a predetermined reference display mode," teaches a clock with an analog display in which the relative movement of the hands is detected and adjusted, so that the proper relationship between the two hands can be maintained. U.S. Utility Pat. No. 6,454,458, by named inventors Born, et. al., entitled, "Timepiece including means for indicating the angular position of coaxial analogue display indicators," teaches the use of a magnetic or capacitive plate to detect the angular position of the two analog hands on an analog dial. U.S. Utility Pat. No. 6,343,050, by named inventor Kwok, entitled, "Analog clock driven by radio signals with automatic resetting means," teaches using a digital clock as a master to an analog clock slave, feeding a time-signal from a time-keeping radio station to the master, and, then, adjusting the slave. U.S. Utility Pat. No. 5,422,863, by named inventors Minowa, et. al., entitled, "Automatically correcting electronic timepiece for selected signal receiving wireless receiver," teaches a master/slave clock arrangement, wherein an electromagnetic signal is used to set the master and a time divider circuit is used to adjust the speed of the slave to synchronize with the master.

There is substantial additional prior art that teach things like master and slave clock arrangements. Some use an analog master to analog slave correction methods, with an analog display. Some use a digital master to analog slave correction methods, with an analog display. Some use a digital master to digital slave correction methods, with a digital display. What the market is looking for is the performance and ease of use of a digital master to digital slave correction topology, that is then converted to an analog display. Such a chronograph would give the market the aesthetics of an analog display, with the accuracy of a digital master and the ease of use of a digital slave

SUMMARY OF THE INVENTION

This summary is intended to disclose the present invention, a chronograph employing a digital master clock that corrects a slave clock, wherein the angular position of the hands on an analog display are adjusted so that the slave clock corresponds to the digital master clock. The embodiments and descriptions are used to illustrate the invention and its utility, and are not intended to limit the invention or its use.

The present invention relates to a timepiece, including a clockwork movement, provided with an analogue display dial. A typical analogue display dial has at least twelve (12) equally spaced symbols or numbers, arranged in an approximately circular fashion. Two hands, or indicators, are attached to separate rotating shafts. One hand, the hour hand, marks the progression of hours, by moving one-twelfth (1/12) of the complete rotation in an hour. The other hand, the minute hand, marks the progression of minutes, by moving in a complete rotation in an hour, or one-sixtieth (1/60) of a complete rotation per minute. The hour hand is connected to a rotating shaft; the minute hand is attached to a separate, rotating shaft. The two rotating shafts share a common axis of rotation, with the minute hand shaft typically nested inside the hour hand shaft.

The present invention uses rotary digital encoders to identify the absolute angular position of the hour-hand shaft and minute-hand shaft, or the hour-hand and the minute hand. The present invention has at least one angular position digital encoder disk attached to the rotational shaft for the hour hand; and at least one angular position digital encoder disk attached to the rotational shaft for the minute hand. In one embodiment, the angular encoder disks are magnetic. In an alternative embodiment, the angular encoder disks are optical. The periphery of the hour shaft digital encoder disk has cogs (gear teeth) that mate with matching cogs on an hour-shaft driving motor. The hour-hand driving motor cogwheel drives the hour-hand digital encoder disk, which causes the hour-hand shaft to rotate. The periphery of the minute hand shaft digital encoder disk also has cogs that mate with a matching cogwheel on a minute-hand drive motor. The minute-hand drive motor cogwheel drives the minute-hand digital encoder disk, which causes the minute-hand shaft to rotate.

In the magnetic-encoder-disk embodiment, at least one surface of each encoder disk has a plurality of alternating (north and south) magnetic poles. The magnetic poles are radially arranged about the disk at six different radii. Each radii represents a bit of the encoder disk, allowing for a binary coded decimal (BCD) integer of up to 64. In one embodiment of the optical encoder disk embodiment, at least one surface of each encoder disk has a plurality of reflective regions. The plurality of reflective regions are designed to reflect a light source, such as a laser or LED, back to a photodiode detector. The plurality of reflective regions are radially arranged about the disk at six different radii. Each radii, again, represents one bit, allowing for a BCD integer of up to 64. In a second embodiment of the optical encoder disk, the surface of the encoder disk has a plurality of slits, holes, or optically transparent regions, allowing a light source, such as a laser or LED to shine through the disk to a photodiode detector. The optically transparent regions are radially arranged about the disk at six different radii, allowing for a BDC integer of up to 64.

In the magnetic encoder disk embodiment, a position sensor can detect the current position of the magnetic encoder disk, and therefore the drive shaft, by decoding the BCD in proximity to the position sensor. For a magnetic encoder disk, at least one magnetic field sensor, such as a Hall Effect sensor, a microelectromechanical sensor ("MEMS"), or other well-known magnetic pick-up sensors, can detect the BCD integer for the current position of the magnetic encoder disk. Likewise, in the optical encoder disk embodiment, a position sensor can detect the current position of the optical encoder disk, and therefore the drive shaft, by decoding the BCD integer in proximity to the position sensor. For an optical encoder disk, at least one light source, such as a laser or LED can be paired with at least one photodiode to detect the BCD for the current position of the optical encoder disk.

The BCD codes for the hour and minute shaft are combined and converted into a time code (hour:minute). The combined time code from the decoder disks is the slave time code. The slave time code is compared to a master time code with a comparator. When the slave time code matches the master time code, the output to the shafts drive motors is turned off. When the slave time code does not match the master time code, a feedback circuit causes the minute-hand drive-motor and/or the hour-hand drive motor to advance the digital encoder disk(s) until the clock hands are in the correct angular position, indicating that the clock is set at the correct time according to the master time code.

The master time code can be generated, internally, by a digital clockworks, using, for example, a piezoelectric oscillator. In the absence of an internal master time code, the master time code can be transmitted to the present invention from an external source, such as a cellphone or another clock. In this way, the timepiece can be automatically reset after a power outage, or when the time changes, such as daylight savings time. Additionally, the present invention can always be made to be synchronized with any clock used as a master clock.

Optionally, the invention can be expanded to also account for a second hand, by adding a second-hand, a second-hand encoder disk, a second-hand drive motor, and a second-hand rotary encoder, and adjusting the system logic accordingly.

BRIEF DESCRIPTION OF THE DRAWINGS

The present invention is illustrated with 9 drawings on 8 sheets.

DETAILED DESCRIPTION OF THE DRAWINGS

The following descriptions are not meant to limit the invention, but rather to add to the summary of invention, and illustrate the present invention, a Digital-to-Digital Correction Unit for an Analog Clock Display. The Digital-to-Digital Correction Unit for an Analog Clock Display is a clock device with an analog clock dial and a digital-to-digital correction unit. The present invention is illustrated with a variety of drawings showing various possible embodiments.

Figure 1:
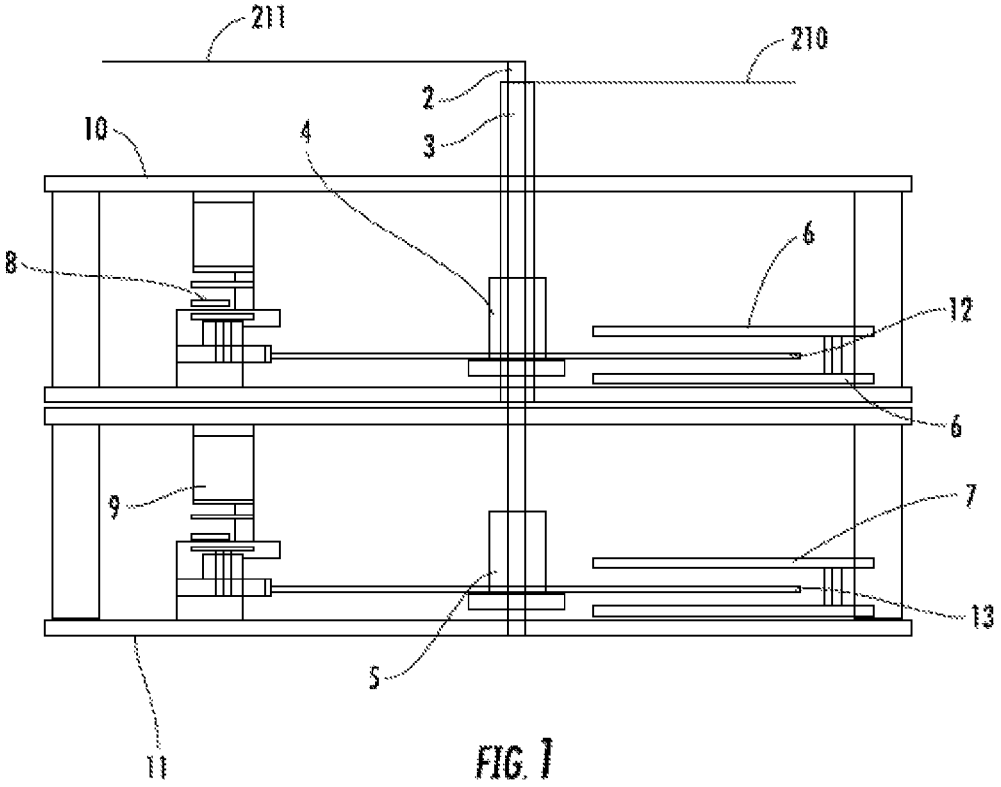
FIG. 1 is a side view of the present invention.

FIG. 1 shows a side view of the present invention. A minute-hand drive-shaft 2 is attached to a minute hand 211. The minute-hand drive-shaft 2 is also attached to a minute-hand encoder disk 13 with a non-slip coupling 5. Likewise, an hour-hand drive-shaft 3 is attached to an hour hand 210. The hour-hand drive-shaft 3 is also attached to an hour-hand encoder disk 12 with a non-slip coupling 4. The edge of the minute-hand encoder disk 13 has a plurality of cogs. The cogs on the edge of the minute-hand encoder disk 13 engage with cogwheel attached to minute-hand shaft drive-motor 9. The edge of the hour-hand encoder disk 12 has a plurality of cogs. The cogs on the edge of the hour-hand encoder disk 12 engage with a cogwheel attached to the hour-hand shaft drive-motor 8. The surface of the minute-hand encoder disk 13 is in proximity with a minute-hand sensor pick-up assembly 7 called a rotary encoder 7. The surface of the hour-hand encoder disk 12 is in proximity with an hour-hand sensor pick-up assembly 6 called a rotary encoder 6. The present invention has a base 11. The present invention also has an analog clock display 10.

Figure 2B:
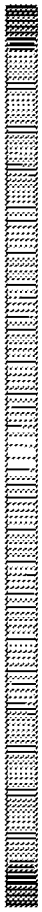
FIG. 2B is a side view of an optical encoder disk.
Figure 2A:
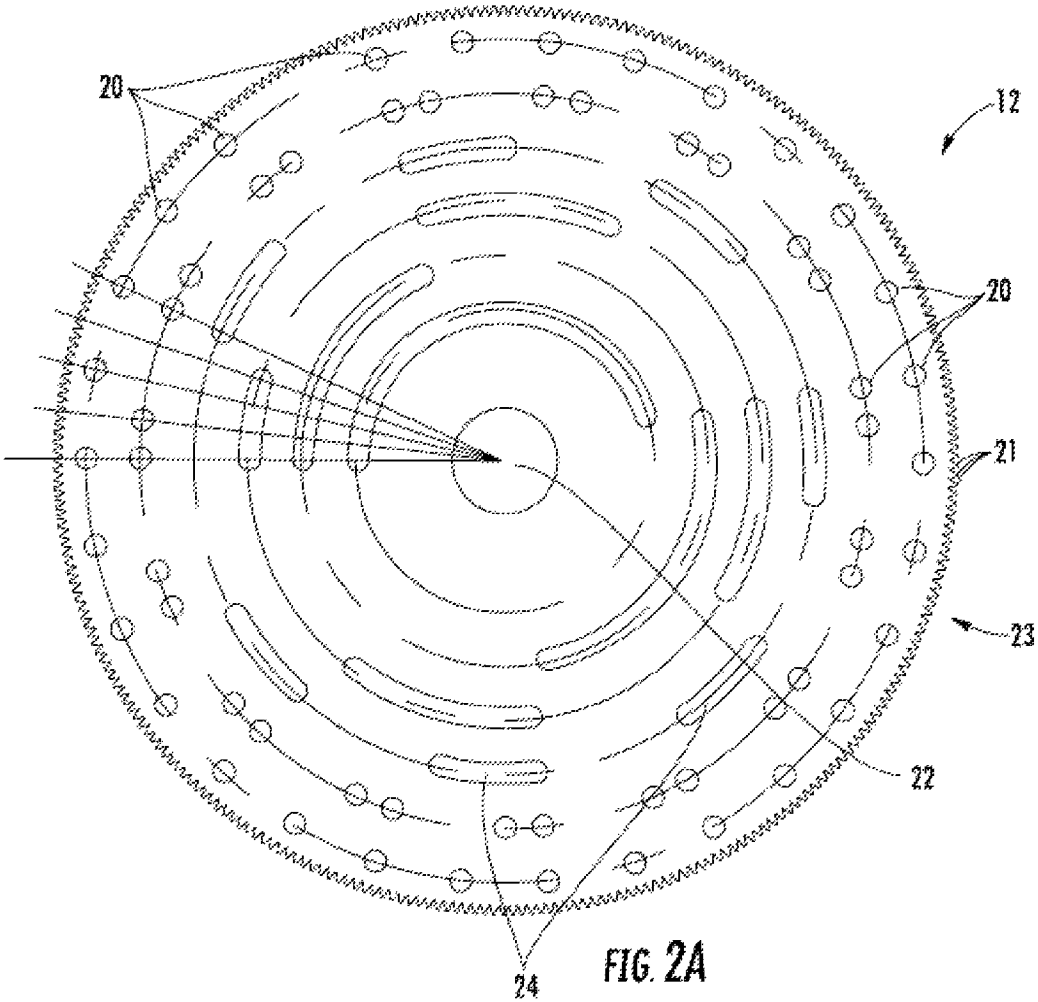
FIG. 2A is a top view of an optical encoder disk.
Figure 2C:
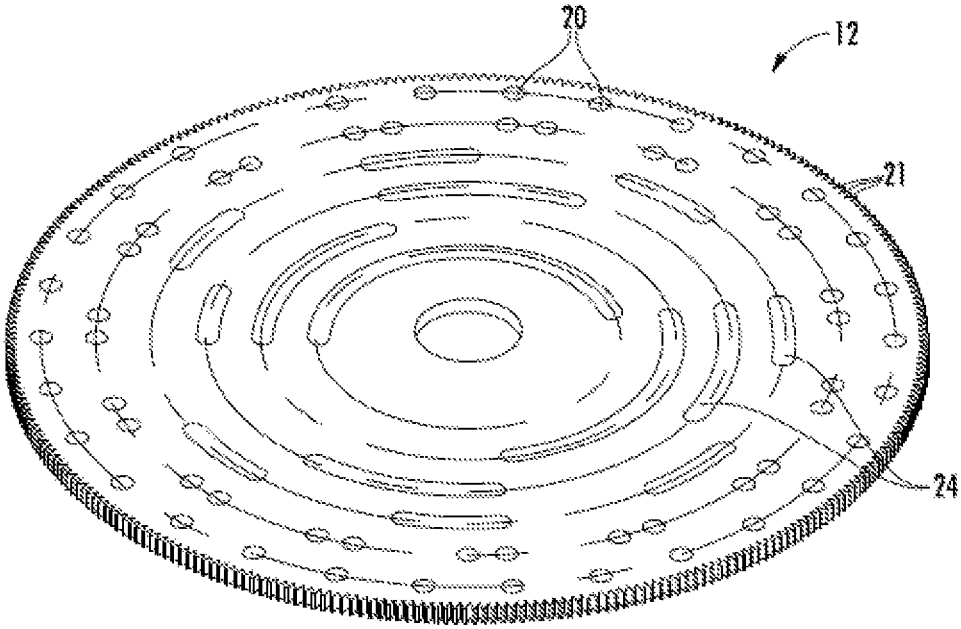
FIG. 2C is an isometric view of an optical encoder disk.

FIGS. 2A, 2B, and 2C show various views of an optical encoder disk 12. The surface of the optical encoder disk 12 has a plurality of reflective zones 20, 24, radially arranged about the disk 12. The reflective zones 20, 24 are positioned about six discrete radii. Some of the reflective zones 20 are circular. Some of the reflective zones 24 are elongated around the radius. The periphery 23 of the disk 12 has a plurality of cogs (teeth) 21. The center 22 of the disk 12 engages with a non-slip coupling 4 which durably attaches the disk 12 to the shaft 3.

Figure 4:
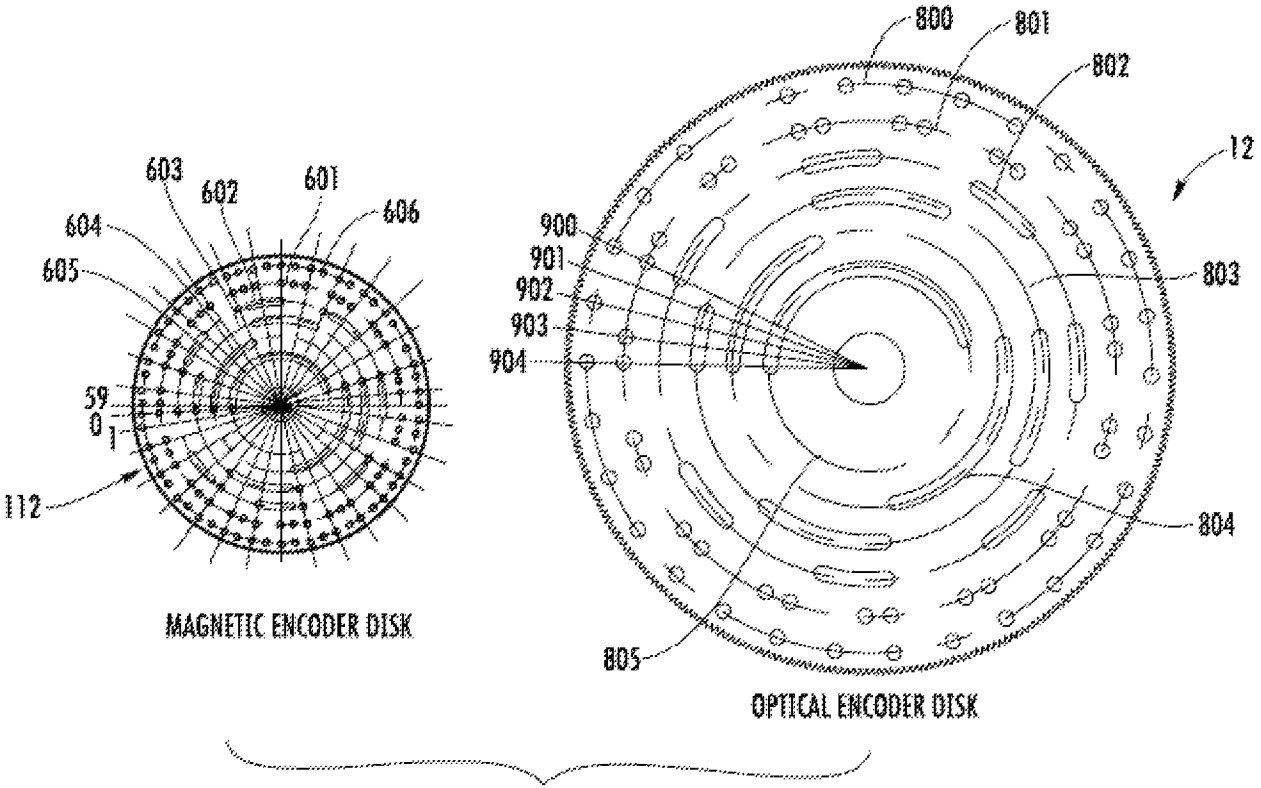
FIG. 4 is a top view of a magnetic encoder disk and an optical encoder disk.

FIG. 4 shows a magnetic encoder disk 112 and an optical encoder disk 12, side-by-side. The magnetic encoder disk has a plurality of south poles and north poles arranged radially. A radial line 59 passes through a sequence of radial bits 59 extending from the center to the outer periphery of the magnetic encoder disk 112 runs through a plurality of poles, creating BCD integers 0, 1. The radial bits 59 create a BCD integer 0, 1 when read by a suitable pick-up device. For example, the radial line 0 passes through the bits 111111, which can be interpreted as a BCD integer corresponding to hours, minutes, or seconds. Likewise, the optical encoder stores BCD integers corresponding to a sequence of radial lines 900, 901, 902, 903, 904. For example, radial line 900 passes through bits 111011, which can be interpreted as a BCD integer corresponding to hours, minutes, or seconds. The encoder disks 112, 12 uses six radial bits 600, 601, 602, 603, 604, 605, 800, 801, 802, 803, 804, 805.

Figure 3A:
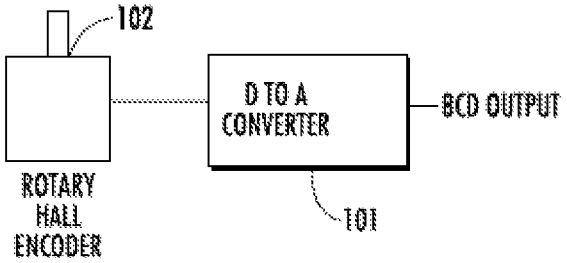
FIGS. 3A and 3B show block diagrams.
Figure 3B:
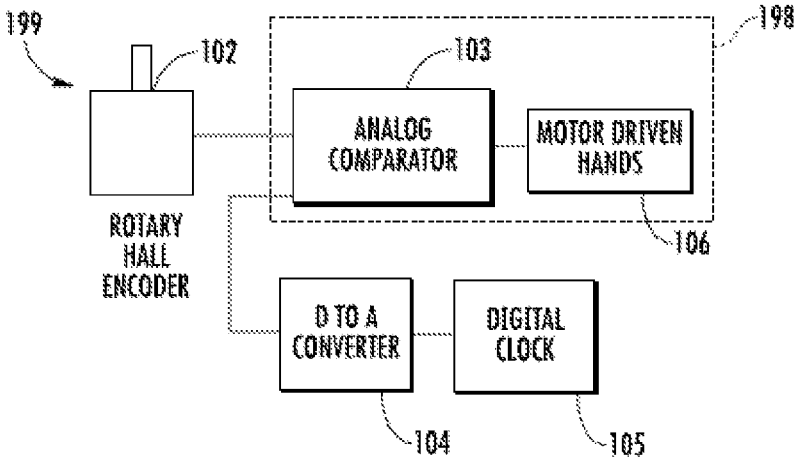

FIGS. 3A and 3B show block diagrams of the time correction circuitry 199 logic used in the present invention. In particular, FIGS. 3A and 3B are for an embodiment using a magnetic encoder disk. Except for the rotary hall encoder 102, the rest of the time correction circuitry 199 is the same for all embodiments. The rotary hall encoder 102 is used with a magnetic encoder disk 112, to read the radial bits 59. In FIG. 3A, by running the radial bits 59 through a digital to analog converter 101, the invention creates a BCD integer. The BCD integer can be logically converted into a time code (hours:minutes). The BCD integer from the rotary hall encoder 102, acting as a time code slave, is fed into a circuit comprised of a comparator 103 and a logic circuit that drives the motor driven hands 106. The BCD integer from the rotary hall encoder 102 is fed into the comparator 103. A time code master, from a digital clock 105 and a digital to analog converter 104 is also fed into a comparator. The results from the comparator 103 is fed into a logic circuit that drives the motor driven hands 106. When the slave time code 101 and the master time code 104 are equal, the motors are not driven. When the slave time code 101 does not equal the master time code 104, the motors rotate the hands until the slave time code 101 equals the master time code 104. The comparator 103 and logic circuit that drives the motor driven hands 106 constitute a feedback circuit 198.

Figure 5:
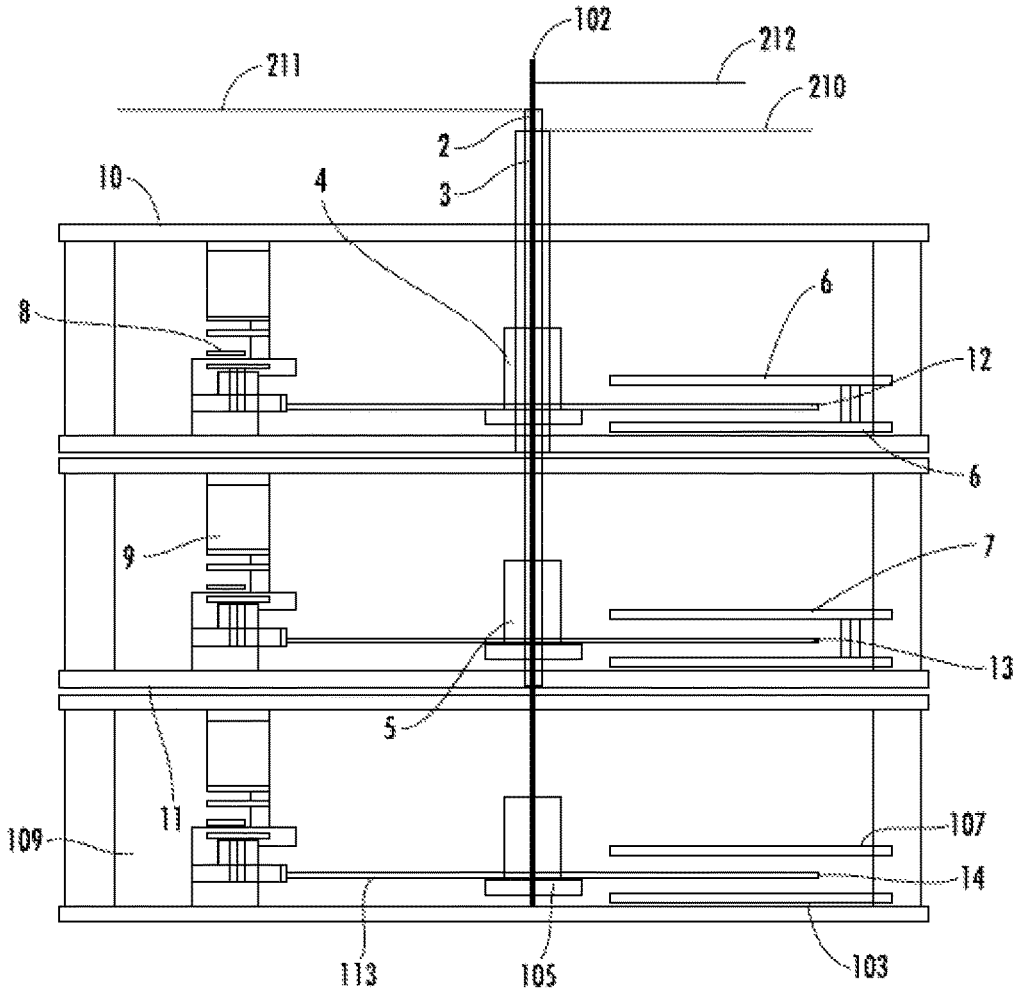
FIG. 5 is a side view of the present invention, with second-hand.

The master time code 104 comes from a digital clock 105, which can either be internal to the present invention, or can be transmitted to the present invention from an external digital clock 105. This allows the present invention to (1) recover from a power outage; (2) adjust to daylight savings time; and (3) be synchronized with another clock. FIG. 5 shows an embodiment of the present invention for a clock with a second hand. The present invention can incorporate a second-hand 212 by adding to the mechanism a second-hand 212, a second-hand shaft 102, a second-hand coupling 105, a second-hand encoder disk 14, a second-hand drive motor 109, and a second-hand rotary encoder 107. The system logic of the time correction circuitry 199, such as the BCD integer time code (hour:minutes:seconds) would need to be adjusted to correctly incorporate a second hand 212.

Figure 6:
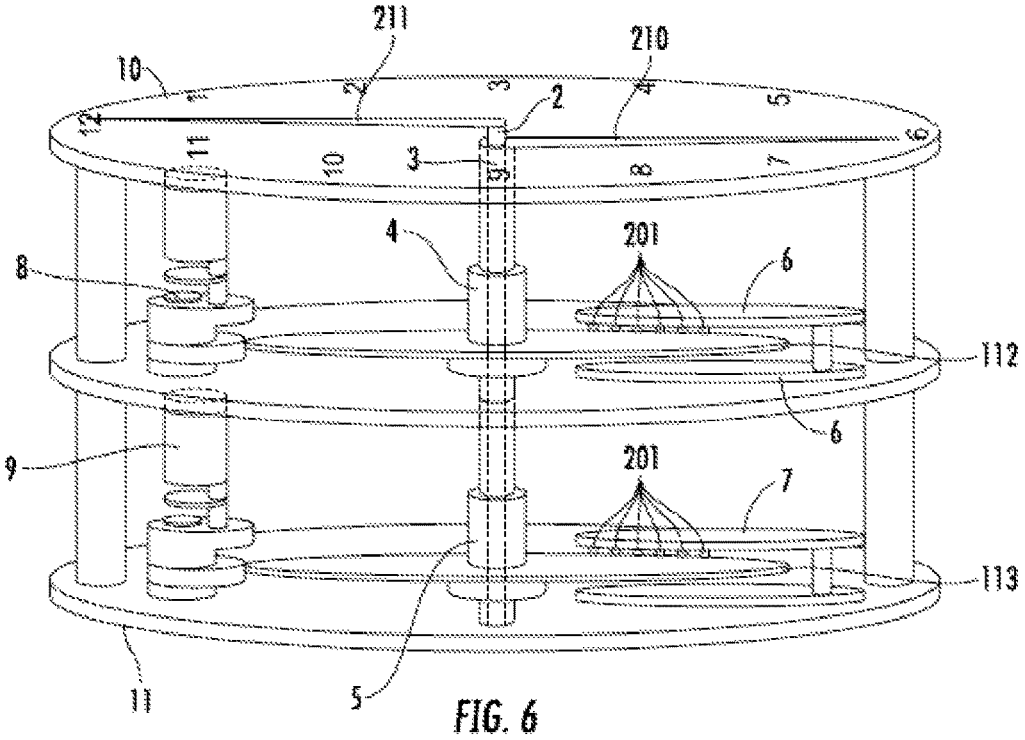
FIG. 6 is a perspective view of the present invention.
Figure 8:
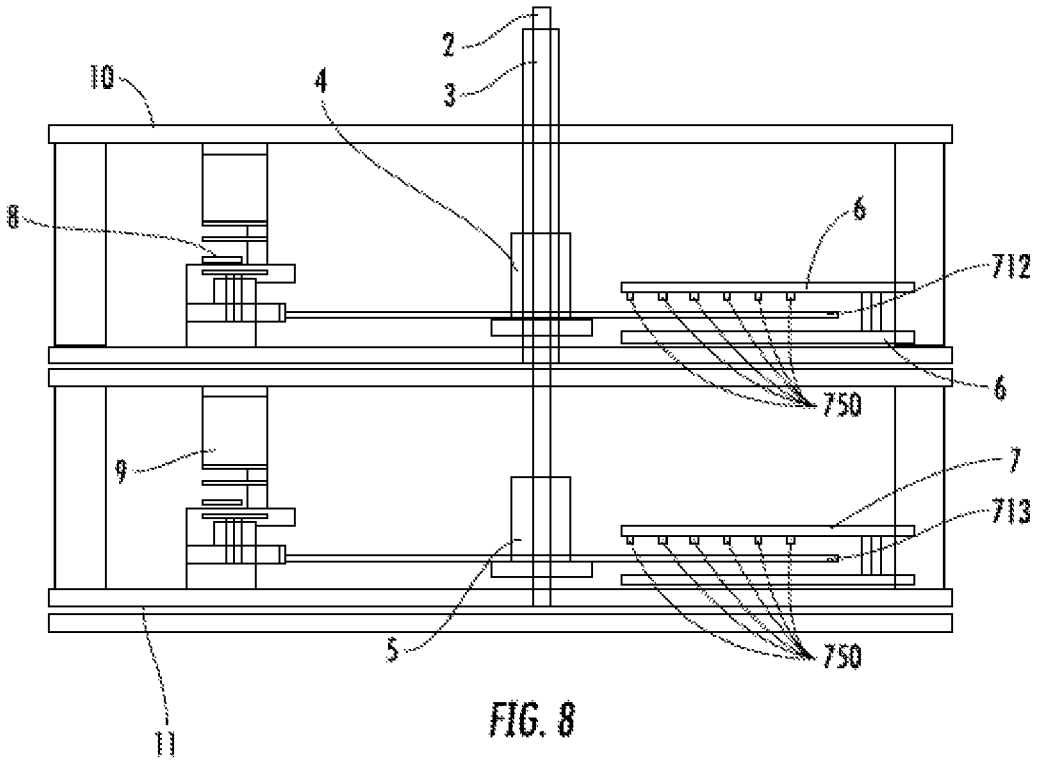
FIG. 8 is a side view of an alternative embodiment of the present invention.

FIG. 6 shows a perspective view of the present invention, using a hour hand 210 magnetic encoder disk 112 and a minute hand 211 magnetic encoder disk 113. The analog clock face 10 is visible in this view, as are the hour hand 210 and minute hand 211. The hour-hand sensor pick-up assembly 6, called an hour-hand rotary encoder 6, uses a plurality of Hall Effect Sensors 201 referred to in the logic diagram (FIG. 3) as the rotary hall encoder 102. In practice, the Hall Effect Sensors 201 would likely be flush-mounted into the hour-hand rotary encoder 6, leaving the cross-section of the hour-hand rotary encoder 6 to appear like that shown in FIG. 1. The minute-hand sensor pick-up assembly 7, called a minute-hand rotary encoder 7, uses a plurality of Hall Effect Sensors 201 referred to in the logic diagram (FIG. 3) as the rotary hall encoder 102. In practice, the Hall Effect Sensors 201 would likely be flush-mounted into the minute-hand rotary encoder 7, leaving the cross-section of the minute-hand rotary encoder 7 to appear like that shown in FIG. 1. FIG. 8 shows a lateral view of the present invention using MEMS sensors 750 with MEMS-compatible encoder disks 712, 713.

Figure 7:
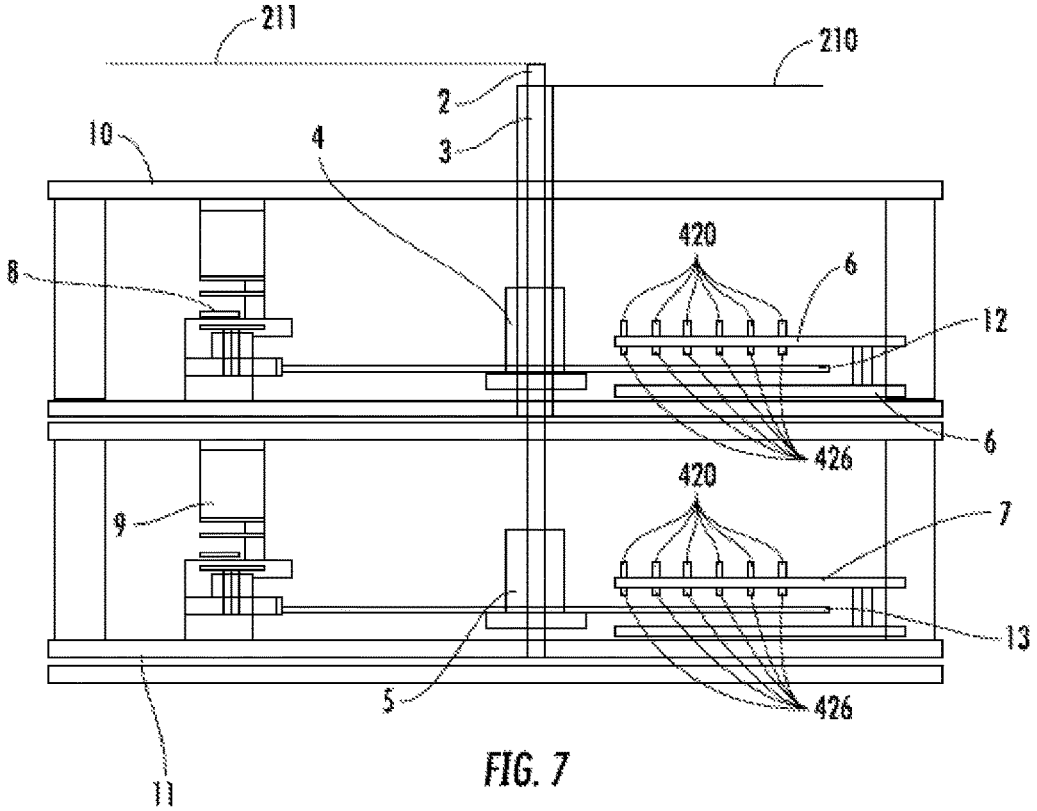
FIG. 7 is a side view of an alternative embodiment of the present invention.
Figure 9:
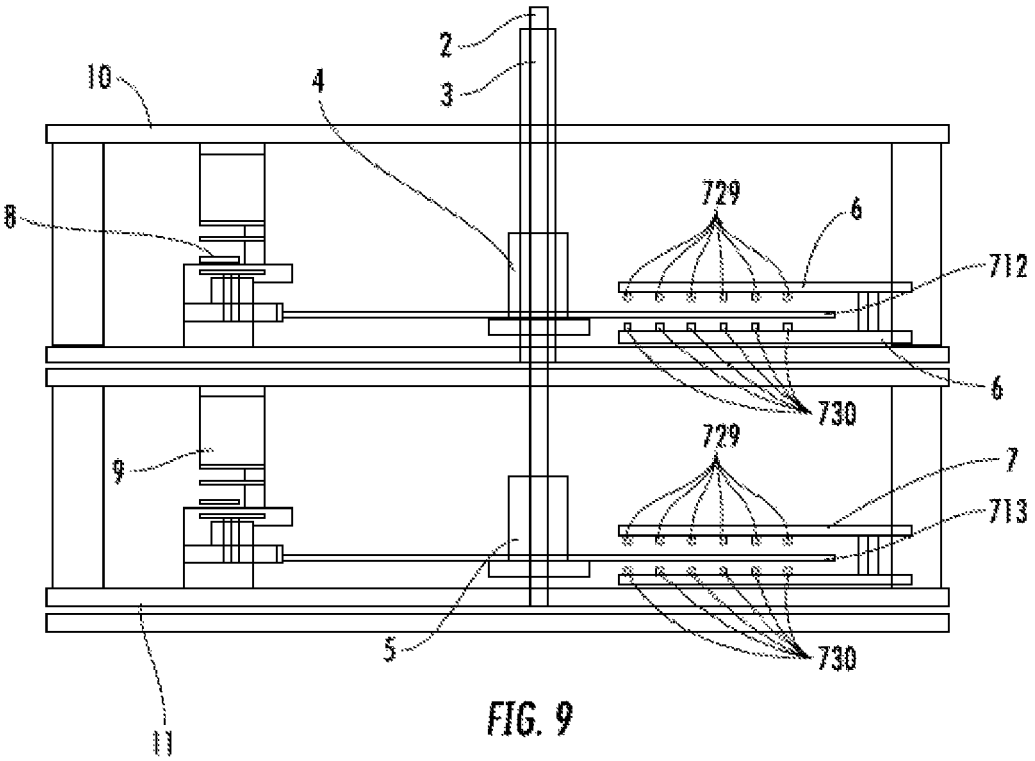
FIG. 9 is a side view of an alternative embodiment of the present invention.

FIG. 7 shows a side view of the present invention, using a hour-hand 210 optical encoder disk 12 and a minute hand 211 optical encoder disk 13. The hour-hand sensor pick-up assembly 6, called an hour-hand rotary encoder 6, uses a plurality of lasers 420 and a like number of photodiodes 426. In practice, the lasers 420 and photodiodes 426 would likely be flush-mounted into the hour-hand rotary encoder 6, leaving the cross-section of the hour-hand rotary encoder 6 to appear like that shown in FIG. 1. The minute-hand sensor pick-up assembly 7, called a minute-hand rotary encoder 7, uses a plurality of lasers 420 and a like number of photodiodes 426. In practice, the lasers 420 and photodiodes 426 would likely be flush-mounted into the minute-hand rotary encoder 7, leaving the cross-section of the minute-hand rotary encoder 7 to appear like that shown in FIG. 1. FIG. 9 shows a variation of the optical encoder disk 512, 513 in which the optical encoder disk 512, 513 allow light to pass through. In this embodiment, the light source is routinely an LED 729, and the pick-up is a photodiode 730.

I claim:

1. A clock device with an analog display and a time correction unit comprising an analog clock dial with an hour hand and a minute hand in proximity to, and parallel with, the clock dial;

an hour-hand shaft connected to and supporting the hour hand; a minute-hand shaft connected to and supporting the minute hand;

wherein the relative position of the hour hand and hour-hand shaft with respect to the analog clock dial is the angular position of the hour hand and hour-hand shaft; and wherein the relative position of the minute hand and minute-hand shaft with respect to the analog clock dial is the angular position of the minute hand and minute-hand shaft;

an hour-hand digital encoder disk with peripheral cogs, encoded with information identifying the angular position of at least one of the hour-hand and the hour-hand shaft; a minute-hand digital encoder disk with peripheral cogs, encoded with information identifying the angular position of at least one of the minute-hand and minute-hand shaft;

a first non-slip coupling, permanently attaching the center of the hour-hand digital encoder disk to the hour-hand shaft in a non-slip fashion; a second non-slip coupling, permanently attaching the center of the minute-hand digital encoder disk to the minute-hand shaft in a non-slip fashion;

an hour-hand drive motor, attached to the hour-hand digital encoder disk with a cogwheel; a minute-hand drive motor, attached to the minute-hand digital encoder disk with a cogwheel;

an hour-hand rotary encoder, comprised of at least one sensor capable of reading the angular position information from the hour-hand encoder disk; a minute-hand rotary encoder, comprised of at least one sensor capable of reading the angular position information from the minute-hand encoder disk;

a circuit that converts the angular position information from the minute-hand rotary encoder and the angular position information from the hour-hand rotary encoder into a slave time code;

a master time code from a digital clock source;

a feedback circuit that controls the speed of the minute-hand drive motor and the hour-hand drive motor, so that the slave time code continuously equals the master time code;

wherein the angular position information encoded on the minute-hand encoder disk is arranged in at least six concentric circles, with at least six discrete radii, corresponding to a BCD integer of at least six bits; and wherein the angular position information encoded on the hour-hand encoder disk is arranged in at least six concentric circles, with at least six discrete radii, corresponding to a BCD integer of at least six bits.

2. The clock device with an analog display and time correction unit of claim 1, wherein the hour-hand encoder disk stores angular position information on a readable magnetic substrate.

3. The clock device with an analog display and time correction unit of claim 2, wherein the at least one hour-hand rotary encoder sensor is a Hall Effect sensor.

4. The clock device with an analog display and time correction unit of claim 2, wherein the at least one hour-hand rotary encoder sensor is a microelectromechanical sensor ("MEMS").

5. The clock device with an analog display and time correction unit of claim 2, wherein the minute-hand encoder disk stores angular position information on a readable magnetic substrate.

6. The clock device with an analog display and time correction unit of claim 5, wherein the at least one minute-hand rotary encoder sensor is a Hall Effect sensor.

7. The clock device with an analog display and time correction unit of claim 5, wherein the at least one minute-hand rotary encoder sensor is a microelectromechanical sensor ("MEMS").

8. The clock device with an analog display and time correction unit of claim 2, wherein the minute-hand encoder disk stores angular position information on an optically readable substrate.

9. The clock device with an analog display and time correction unit of claim 8, wherein the at least one minute-hand rotary encoder sensor uses at least one LED and at least one photodiode.

10. The clock device with an analog display and time correction unit of claim 8, wherein the at least one minute-hand rotary encoder sensor uses at least one laser and at least one photodiode.

11. The clock device with an analog display and time correction unit of claim 1, wherein the hour-hand encoder disk stores angular position information on an optically readable substrate.

12. The clock device with an analog display and time correction unit of claim 11, wherein the at least one hour-hand rotary encoder sensor uses at least one LED and at least one photodiode.

13. The clock device with an analog display and time correction unit of claim 11, wherein the at least one hour-hand rotary encoder sensor uses at least one laser and at least one photodiode.

14. The clock device with an analog display and time correction unit of claim 11, wherein the minute-hand encoder disk stores angular position information on a readable magnetic substrate.

15. The clock device with an analog display and time correction unit of claim 14, wherein the at least one minute-hand rotary encoder sensor is a Hall Effect sensor.

16. The clock device with an analog display and time correction unit of claim 14, wherein the at least one minute-hand rotary encoder sensor is a microelectromechanical sensor ("MEMS").

17. The clock device with an analog display and time correction unit of claim 11, wherein the minute-hand encoder disk stores angular position information on an optically readable substrate.

18. The clock device with an analog display and time correction unit of claim 17, wherein the at least one minute-hand rotary encoder sensor uses at least one LED and at least one photodiode.

19. The clock device with an analog display and time correction unit of claim 17, wherein the at least one minute-hand rotary encoder sensor uses at least one laser and at least one photodiode.

20. The clock device with an analog display and time correction unit of claim 1, further comprising a second-hand, a second-hand shaft, a second-hand coupling, a second-hand encoder disk, a second-hand drive motor, and a second-hand rotary encoder; and wherein the angular position information encoded on the second-hand encoder disk is arranged in at least six concentric circles, with at least six discrete radii, corresponding to a BCD integer of at least six bits.

* * * * *